US005597415A

United States Patent [19]

Graf

[11] Patent Number: 5,597,415

[45] Date of Patent: Jan. 28, 1997

[54] PROFILING BAR FOR A WEB COATING DEVICE

[75] Inventor: Edwin X. Graf, Menasha, Wis.

[73] Assignee: Voith Sulzer Paper Technology North America, Inc., Appleton, Wis.

[21] Appl. No.: 385,779

[22] Filed: Feb. 9, 1995

[51] Int. Cl.[6] ..... B05C 21/00

[52] U.S. Cl. ..... 118/123; 118/126; 118/261; 118/413; 118/419; 162/281; 101/157; 101/169; 101/365; 15/256.5; 15/256.51

[58] Field of Search ..... 118/123, 126, 118/261, 413, 419; 162/281; 101/157, 169, 365; 15/256.5, 256.51

[56] References Cited

U.S. PATENT DOCUMENTS

| | | | |
|---|---|---|---|
| 4,507,073 | 3/1985 | Shelton | 101/169 |
| 4,638,733 | 1/1987 | Schneider et al. | 101/169 |
| 5,074,243 | 12/1991 | Knop et al. | 118/126 |
| 5,081,951 | 1/1992 | Most et al. | 118/126 |
| 5,480,486 | 1/1996 | Burns | 118/123 |

FOREIGN PATENT DOCUMENTS

| | | |
|---|---|---|
| 2102287 | 9/1993 | Canada . |
| WO93/05887 | 9/1992 | WIPO . |

*Primary Examiner*—Laura Edwards
*Attorney, Agent, or Firm*— Baker & Daniels

[57] ABSTRACT

A metering device for use in a coating apparatus for coating a moving web running over a backing member wherein the metering device includes a metering blade having an edge disposed in close proximity to the web and a profiling device for selectively changing the profile of the blade edge. The profile bar is joined to a plurality of adjustment actuators by bar limiter elements that are mechanically interlocked such that the movement of each limiter element relative to an adjacent limiter element in the direction of bar deformation is limited to a maximum distance. The edges of adjacent limiter elements are provided with interfitted projections and slots with sufficient clearance to permit only limited relative movement of adjacent limiter elements.

21 Claims, 2 Drawing Sheets

PROFILING BAR FOR A WEB COATING DEVICE

BACKGROUND OF THE INVENTION

The invention relates to a profiling bar for a web coating device used in paper making processes, and in particular to a mechanism for controlling the amount of deformation of the bar during profile adjustment.

In the manufacture of paper, it is often desirable to coat one or both sides of the paper web. The coating mixture is applied to the running paper web, which is typically supported on a rotating roll, and just downstream of the coating application zone, there is positioned a metering blade that controls the thickness of the coating to remain on the web. An example of a coating apparatus is disclosed in U.S. Pat. No. 4,903,632, which patent is incorporated herein by reference.

The purpose of the metering blade, which is also often referred to as a doctor blade, is to control the thickness of the coating on the web. It is often desirable to modify the profile of the edge of the metering blade across the width of the web. A commonly utilized mechanism for doing this is a profile bar typically made of stainless steel and having an edge that engages a side face of the metering blade and extends the entire width of the web. Spindles or other adjustment mechanisms, such as air bags or pivoting actuators, engage the opposite edge of the profile bar at spaced apart directions along the axis of the bar and apply tensile or compressive forces to deform the bar so as to change the profile of the leading edge of the bar. This in turn deforms the metering blade so that the spacing of the metering blade edge from the surface of the web can vary across the width of the web.

A problem with prior art profile bars is that the bar can be deformed locally beyond its elastic limit to thereby cause permanent plastic deformation of the bar. Such plastic deformation of the bar will result in a permanent distortion of the leading edge thereby causing difficulties in making precise adjustments thereafter.

SUMMARY OF THE INVENTION

The profile bar according to the present invention overcomes the disadvantages of the prior art by limiting the relative movement between adjacent portions of the profile bar. This is accomplished by connecting the profile bar to the individual actuator mechanisms or spindles through a series of mechanically interconnected limiter elements, wherein adjacent elements are capable of moving relative to each other in the direction of deformation but only to a limited extent. In the preferred form of the invention, the limiter elements are interfitted by means of projections or tabs that are received in slots on the adjacent limiter elements. Although gradual deformation can take place along the length of the profile bar to a considerable degree, localized deformation from one section to the next is limited so that the elastic limit of the profile bar is not exceeded.

In a preferred form of the invention, the profile bar is made of titanium rather than stainless steel, as is conventional with prior art profile bars. The titanium profile bar allows greater elastic movement and provides improved corrosion resistance.

The adjustment of the profile bar is preferably accomplished by means of a plurality of threaded spindles that engage the edge portion of the profile bar. By avoiding the use of air bags and pivoting arrangements, the stick/slip phenomenon of the prior art is avoided.

The invention, in one form thereof, is a profiling device for a coating metering blade for use in a moving web coating system wherein the profiling device comprises an elongate, non-segmented profile bar defining an axis and being deformable in a direction transverse to the axis. A plurality of independently moveable bar limiter elements are attached to the profile bar at a plurality of axially spaced locations along the bar, and a plurality of adjustment actuators are connected respectively to the bar limiters. The bar limiter elements are mechanically interlocked with each other such that the movement of each limiter element relative to an adjacent limiter element in the direction of bar deformation is limited to a maximum distance by the adjacent limiter element, whereby local over-deformation of the profile bar is inhibited.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION

Figure 5:
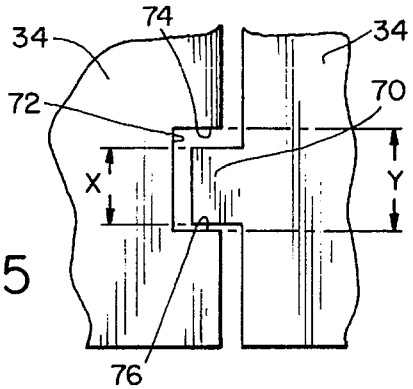
FIG. 5 is an enlarged fragmentary view of two adjacent limiter elements.

With reference now to the drawings, the coating metering apparatus 8 is shown positioned downstream of the coating applicator (not shown) in the direction of movement of web 10, which is supported by rotating roll 12. Support base 14 includes a clamping mechanism 16 that supports a metering blade 18 having an edge 20 that is in close proximity to moving web 10.

Figure 2:
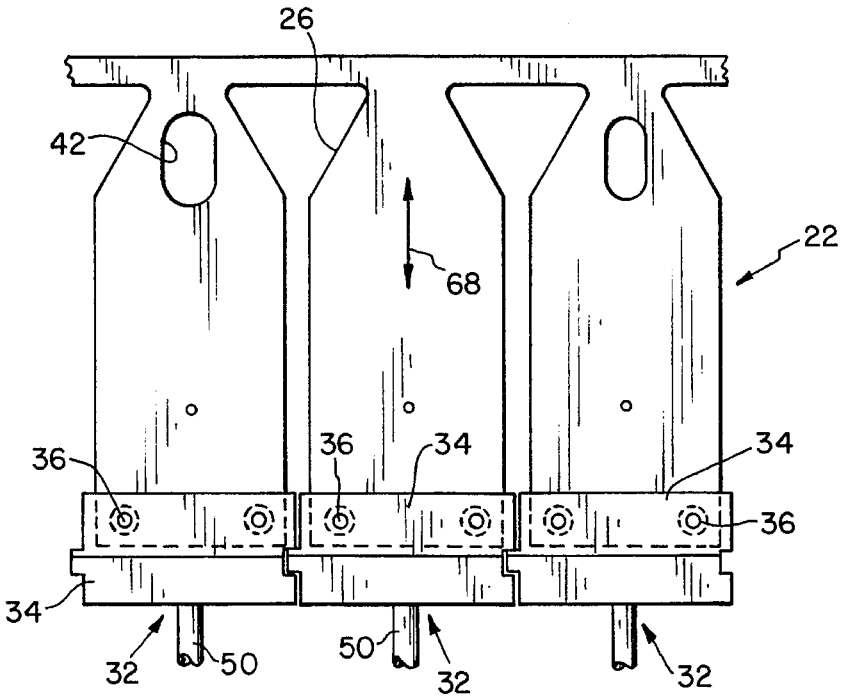
FIG. 2 is a fragmentary plan view of the profile bar.
Figure 3:
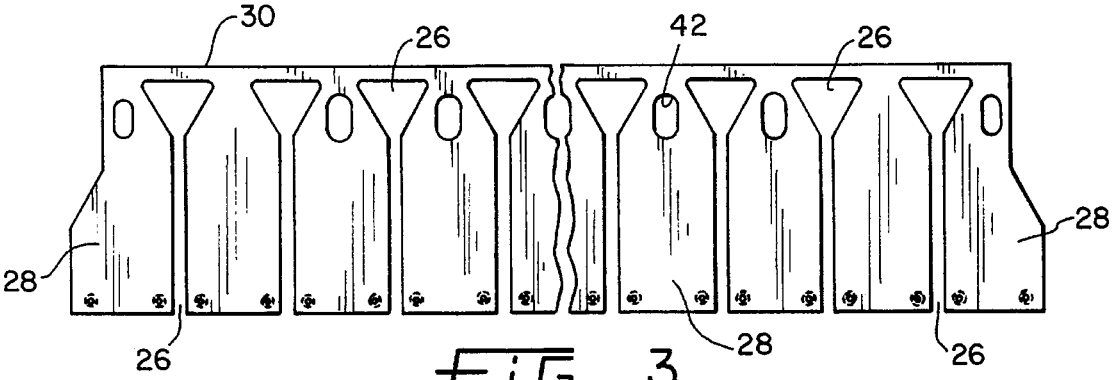
FIG. 3 is a plan view of the profile bar wherein the profile adjustment mechanism has been removed for the sake of clarity.

The profiling apparatus 8 includes profile bar 22 made of commercially pure titanium for example, such as Ti-50A or equivalent, ASTM B256 GR2, and has a generally elongate shape as best shown in FIG. 3. Profile bar 22 extends across the width of web 10 and is supported on the inclined upper surface 24 of support base 14. With reference to FIGS. 2 and 3, profile bar 22 is provided with a plurality of laser cut relief spaces 26 that form a plurality of sections 28 joined together along the leading edge 30 of bar 22. Although bar 22 could be formed of continuous material, the relief spaces 26 cause the bar 22 to have greater elasticity and be capable of easier deformation with lower force requirements.

Figure 1:
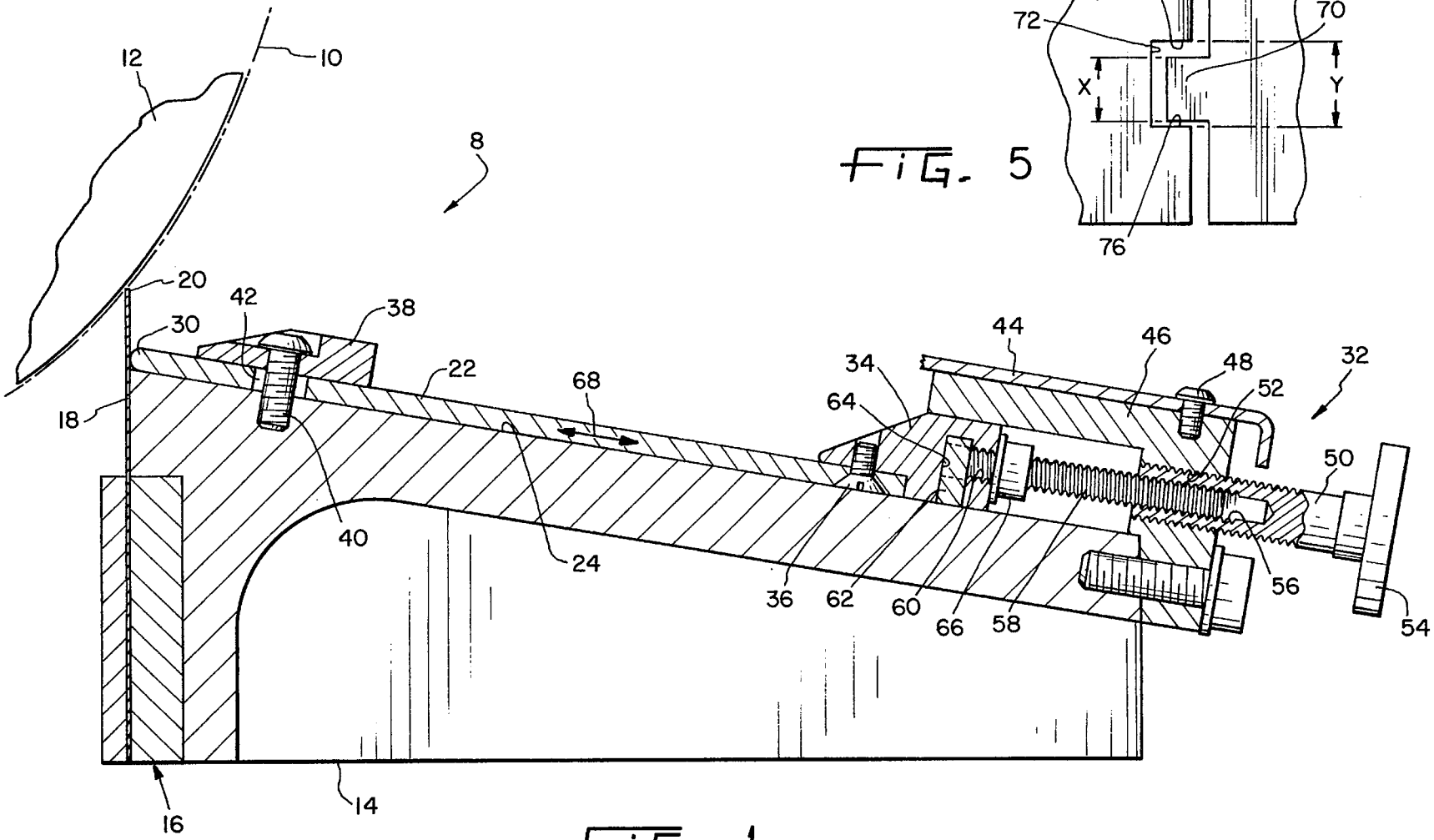
FIG. 1 is a sectional view showing a web coating apparatus incorporating the profile bar according to the present invention.

With reference in particular to FIGS. 1 and 2, a plurality of axially spaced actuators are mounted on the rear edge of support base 14 and are connected to profile bar 22 through a plurality of respective bar limiter elements 34. A separate, independently moveable limiter element 34 is connected to each of the profile bar sections 28 by means of screws 36 that pass through clearance openings in bar 22 and are threadedly received in the leading edge portion of limiter elements 34. At the forward end of bar 22 is provided a shroud attachment bracket that is attached thereto by means of screws 40 extending through slots 42 in bar 22 and being threadedly received in base 14. A shroud 44 is attached to housing 46 by screws 48 and extends forwardly and attaches to bracket 38 by attachment means (not shown).

Actuator device 32 comprises a shaft 50 that is threadedly received within bore 52 of housing 46 and is provided with a hand operated knob 54. Shaft 50 includes a threaded bore 56 that is in threaded engagement with spindle 58, and spindle 58 passes through a clearance opening 60 in limiter element 34 and is threadedly secured to retainer bar 62 received within a slot 64 in limiter element 34. A washer and lock nut assembly 66 lock together spindle 58 and limiter element 34. Shaft 50 is provided with external threads and is threadedly engaged with the bore 52 of housing 46. Bore 56 is in threaded engagement with spindle 58. The pitch of the threads on spindle 58 is different than the threads in bore 52 so that the rotation of shaft 50 causes axial movement of spindle 58 in the direction of distortion of profile bar 22, which is indicated by arrow 68.

In accordance with the present invention, localized movement of each limiter element 34 relative to its adjacent elements is limited to a fairly narrow range because of the mechanical interlocking or interleaving of limiter elements 34. In a preferred form of the invention, limiter elements 34 are each provided with a projection or tab 70 that is received within a respective slot or notch 72 in the adjacent limiter element. In a typical profile bar, there may be nine actuators 32 each connected respectively to axially spaced locations along profile bar 22 by the mechanism just described, although the number of spindle actuators 32 may vary depending on the machine width. Each of the limiter elements is mechanically interlocked with adjacent elements by means of the projections 70 and slots 72 that extend laterally from elements 34. As illustrated in FIG. 5, each projection 70 is narrower than the width of its corresponding slot 72, and surfaces 74 and 76 of slot 72 abut the facing surfaces of projections 70 in the direction of deformation 68 to thereby provide limited relative movement between adjacent limiter elements 34 equal to the difference between width y of slot 72 and width x of projection 70. Although the preferred embodiment of the invention incorporates the projection and slot arrangement shown in FIG. 5, other mechanical interconnecting arrangements are also possible, such as projecting pins received in slots, alternating projections and open recesses, and other mechanical arrangements.

Figure 4:
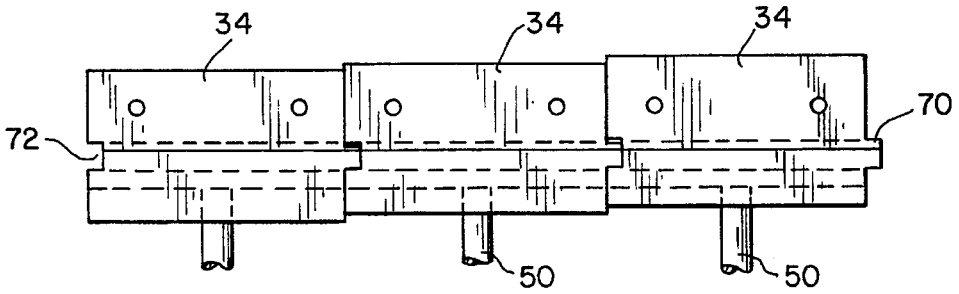
FIG. 4 is a plan view of three of the interfitted limiter elements.

As shown in FIG. 4, considerable movement of a limiter element 34 relative to another limiter element 34 that is spaced further away can be achieved as compared to what is possible with regard to adjacent limiter elements 34. Thus, although wide variations in deformation of profile bar 22 are possible across its width, localized deformations are limited, and it is the localized deformations that cause deformation into the plastic range of the material of profile bar 22 and therefor must be avoided. The positive mechanical stops provided by one limiter element 34 relative to its adjacent elements 34 maintains deformation of bar 22 within an acceptable range.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A profiling device for a coating metering blade for use in a moving web coating system, said profiling device comprising:

an elongate non-segmented profile bar defining an axis and being deformable in a direction transverse to said axis, a plurality of independently moveable bar limiter elements attached to said profile bar at a plurality of axially spaced locations along said bar, and a plurality of adjustment actuators connected respectively to said bar limiter elements, said bar limiter elements being mechanically interlocked with each other such that the movement of each limiter element relative to an adjacent said limiter element in the direction of bar deformation is limited to a maximum distance by said respective adjacent limiter element, whereby local over-deformation of said profile bar is inhibited.

2. The profiling device of claim 1 wherein each of said limiter elements includes one of a projection or recess that interconnects with the other of a projection or recess of an adjacent said limiter element, said interconnected projections and recesses including abutting surfaces to thereby limit the relative movement between the respective adjacent limiter elements.

3. The profiling device of claim 2 wherein said recess includes two wall surfaces confining movement of said interlocking projection in the direction of deformation.

4. The profiling device of claim 3 wherein each of said limiter elements except endmost said elements includes a projection or recess on opposite sides thereof, each of said projection or recess interconnecting with a projection or recess on each limiter element adjacent thereto.

5. The profiling device of claim 1 including at least three said limiter elements and respective said actuators.

6. The profiling device of claim 1 wherein the material of said profile bar is titanium.

7. The profiling device of claim 1 wherein said profile bar includes relief spaces between said spaced locations to thereby form a plurality of sections joined together along a leading edge of said profile bar.

8. The profiling device of claim 1 wherein each said adjustment actuator comprises a moveable spindle that engages an edge of said profile bar.

9. The profiling device of claim 1 wherein the mechanical interlocking of said limiter elements is achieved by means of a plurality of axially extending projections on said limiter elements that are received within slots on adjacent limiter elements, said slots being longer in the direction of deformation than said projections.

10. The profiling device of claim 9 wherein said limiter elements are guided by a housing for movement in the deformation direction.

11. The profiling device of claim 9 wherein each of said limiter elements except endmost limiter elements comprises a said projection on one side thereof and a said slot on the opposite side thereof.

12. The profiling device of claim 1 wherein said limiter elements are interfitted to thereby positively limit relative movement between adjacent said limiter elements.

13. The profiling device of claim 12 wherein lateral edges of said limiter elements are interfitted.

14. A metering device for use in a coating apparatus for coating a moving web running over a backing member, said metering device comprising a metering blade having an edge disposed in proximity to the web and a profiling device for selectively changing the profile of the blade edge, said profiling device comprising:

an elongate non-segmented profile bar defining an axis and having an edge in engagement with a face of said metering blade, and a plurality of adjustment means connected at axially spaced apart locations along said profile bar for independently locally deforming said profile bar to thereby change the profile of said metering blade, said adjustment means comprising a plurality of independently moveable bar limiter elements secured to said profile bar respectively at said spaced apart locations and a plurality of respective actuators that engage and move said bar limiter elements in the direction of bar deformation;

said bar limiter elements being mechanically interlocked with each other such that the movement of each limiter element in the direction of profile bar deformation is limited to a maximum distance by at least one adjacent said limiter element, whereby local over-deformation of said profile bar is inhibited.

15. The metering device of claim 14 wherein each of said limiter elements includes one of a projection or recess that interconnects with the other of a projection or recess of an adjacent said limiter element, said interconnected projections and recesses including abutting surfaces to thereby limit the relative movement between the respective adjacent limiter elements.

16. The metering device of claim 15 wherein said recess includes two wall surfaces confining movement of said interlocking projection in the direction of deformation.

17. The metering device of claim 14 wherein the mechanical interlocking of said limiter elements is achieved by means of a plurality of axially extending projections on said limiter elements that are received within slots on adjacent limiter elements, said slots being longer in the direction of deformation than said projections.

18. The metering device of claim 17 wherein said limiter elements are guided by a housing for movement in the deformation direction.

19. The metering device of claim 14 wherein the material of said profile bar is titanium.

20. The metering device of claim 14 wherein said profile bar includes relief spaces between said spaced locations to thereby form a plurality of sections joined together along the leading edge of said profile bar.

21. The metering device of claim 20 wherein each said actuator comprises a moveable spindle that engages an edge of said profile bar.

* * * * *